US005083961A

United States Patent [19]

Ishiwa

[11] Patent Number: 5,083,961

[45] Date of Patent: Jan. 28, 1992

[54] INFLATABLE TOY UNIT

[75] Inventor: Takuzo Ishiwa, Tokyo, Japan

[73] Assignee: Ringstone Co., Ltd., Tokyo, Japan

[21] Appl. No.: 536,788

[22] Filed: Jun. 12, 1990

[30] Foreign Application Priority Data

Sep. 26, 1989 [JP] Japan ..... 1-112341[U]

[51] Int. Cl.[5] ..... A63H 33/38; A63H 3/06; G09F 1/06

[52] U.S. Cl. ..... 446/75; 446/147; 446/220; 272/27 N; 40/124.1

[58] Field of Search ..... 446/220, 223, 226, 5, 446/24, 75, 79, 80, 181, 490; 272/27 N; 40/124.1, 212, 214, 538, 124.3

[56] References Cited

U.S. PATENT DOCUMENTS 1,247,809 11/1917 Foster ..... 446/220 X
1,663,679 3/1928 Carpenter .
2,516,552 7/1948 Clark et al. ..... 446/220 X
4,758,198 7/1988 Ishiwa ..... 446/220
4,781,645 11/1988 Kato ..... 446/221
4,955,412 9/1990 Younts et al. ..... 446/220 X

*Primary Examiner*—Danton D. DeMille
*Attorney, Agent, or Firm*—Nixon & Vanderhye

[57] ABSTRACT

In a bag flying-out toy, a foaming material including a plurality of foaming agents which generate gas at mixing thereof is accommodated in a gas-tight bag toy unit. An accommodating bag unit has its volume at swelling thereof, which is smaller than that of the bag toy unit at swelling thereof. The bag toy unit before swelling thereof is accommodated in a folded manner in the accommodating bag unit. The accommodating bag unit is ruptured at a swelling pressure of the bag toy unit due to the foaming material. Alternatively, the bag toy unit before swelling rests on a substrate. A tearing cover is provided for covering the bag toy unit on the substrate to fixedly mount the bag toy unit to the substrate. The tearing cover is torn off by a swelling pressure of the bag toy unit.

10 Claims, 5 Drawing Sheets

INFLATABLE TOY UNIT

BACKGROUND OF THE INVENTION

The present invention relates to a bag flyingout toy in which a bag toy unit flies out from the interior of an accommodated bag unit.

The following conventional bag toys are known which utilize a foaming material having a pair of blowing or foaming agents for generating gas.

A bag toy is disclosed in Japanese Utility Model Unexamined Publication No. SHO 50-17096, in which an outer shell of a doll swells or is expanded by gas generated when organic matter boils at a temperature equal to or higher than normal temperature.

A bag toy is disclosed in Japanese Utility Model Unexamined Publication No. SHO 56-39086, in which a pair of synthetic resinous sheets have their respective surfaces on which an animal or animals are printed, and have their respective peripheral edges which are bonded to each other in a sealed manner to form a flat or planar bag. Sodium hydrogencarbonate and acidic solution, which are accommodated in the bag in a sealed manner, are reacted with each other to generate gas. The planar bag swells or is inflated by the gas.

In either case of the bag toys described above, the gas is generated due to a change in temperature, or the foaming agents of two-agent mixing type are accommodated in an openable bag in an isolated manner and are mixed with each other within the bag to form the gas. The bag is inflated by the thus obtained gas.

On the other hand, there are the following flying-out toys which do not use the foaming material and in which a figure or form and a configuration change before and after swelling and, particularly, an inner bag protrudes from an external accommodating element at swelling.

A toy is disclosed in Japanese Utility Model Publication No. SHO 4-7459, in which a balloon is inflated at the interior of a predetermined container, and a lid or closure of the container is opened by the swelling force of the balloon.

Further, as a similar toy, a cup-shaped toy is dislosed in Japanese Utility Model Publication No. SHO 13-4109, in which a bag is accommodated in a cup having its opening at which a membrane is spread, the bag swells or is inflated by the utilization of an elastic force of the cup, and the membrane spread at the opening of the cup bursts or is ruptured to cause the bag to protrude.

However, the above-described conventional bag top or flying-out toy per se has the following problem. That is, in the case where the toy is easy in handling. on only a low age group or bracket such as a baby or the like can enjoy the toy, because the contents of the play are limited. Further, if the contents of the play fill up or are enriched so that anyone can enjoy the toy regardless of the age, the handling and construction of the toy become difficult extremely.

Specifically, the bag prior to swelling in the conventional bag toy of the kind referred to above can already be recognized by an onlooker, and a state, in which the bag swells, can be imagined to some degree. Accordingly, in the toy of the kind referred to above, the gas generated by the foaming agents does merely inflates the bag, and, although one can enjoy a change in which the bag swells quickly, one can expect nothing beyond that.

Furthermore, it is required that the foaming material, in which two agents are mixed with each other, is arranged at the same position within the bag toy which is folded up at accommodation, in order to facilitate foaming at the mixing. It is extremely troublesome and cumbersome in the viewpoint of manufacturing that the two agents including liquid and power are arranged at the same position within the gastight bag toy which is folded up.

Moreover, if the two agents are accommodated in the bag toy in a separated manner, there are many cases where inadvertent external pressure ruptures the separated accommodating section between the two agents. For this reason, there is such a problem that the bag toy is extremely easy to be ruptured at accommodation of the bag toy or transportation thereof.

In the manner described above, it is impossible for the conventional bag toy using the foaming agents to provide a too large or big toy, and the contents in a change of the toy per se are also limited. Thus, the object people of the toy is limited to the low age bracket.

On the other hand, the latter flying-out toy has the following problem, which does not use the foaming agents and in which the internal bag protrudes from the external accommodating element. That is, the aforesaid balloon toy is arranged such that air is blown into the balloon from a flute connected to the balloon, and a swelling force of the balloon opens the closure of the container. Accordingly, the construction of the container cannot but become complicated, and the toy per se becomes bulky so that the toy cannot easily be carried. Further, there are required precision of the accommodating element whose closure is reliably opened by the swelling force of the balloon, and strength of the balloon per se, so that provision at a low cost cannot be desired.

Likewise, the cup-shaped toy has the following problem. That is, the toy is arranged such that a force of fingers holding the cup presses the same to feed the air into the bag. Accordingly, a user is limited to at least person who has a force of the order of capable of pressing the cup. In contrast with the aforementioned bag toy which utilizes the foaming agents for generating the gas, a low age bracket cannot use the toy.

Further, in order to enjoy the flying-out toy, it is required that flying-out means is not recognized by an onlooker. Accordingly, in either toy, a knack of certain kind and a force equal to or larger than a predetermined value are required in order to inflate the bag. As a result, the conventional flying-out toy of the kind referred to above can be used as the secret of the trick, but it is difficult for a person who has no knowledge of the juggler's trick or for a low age bracket to play the toy easily.

SUMMARY OF THE INVENTION

It is therefore an object of the invention to provide a bag flying-out toy in which it is possible to enjoy experience rich in thrill by speed at which a bag toy unit is inflated, and by timing at which an accommodating bag unit bursts or is broken and, subsequently, one can suitably play the bag toy unit which has flown out from the accommodating bag.

According to the invention, there is provided a bag flying-out toy comprising:

a gas-tight bag toy unit;

a foaming material including a plurality of foaming agents which generate gas at mixing thereof, the foaming material being accommodated in the bag toy unit in a separated manner; and an accommodating bag unit having its volume at swelling thereof, which is smaller than that of the bag toy unit at swelling thereof wherein the bag toy unit before swelling thereof is accommodated in a folded manner in the accommodating bag unit, and Wherein the accommodating bag unit is ruptured at a swelling pressure of the bag toy unit due to the foaming material.

With the above arrangement of the invention, the foaming agents of the foaming material accommodated in the bag toy unit are mixed and reacted with each other to generate the gas, whereby the bag toy unit swells or is inflated. The accommodating bag unit having its volume at swelling thereof, which is smaller than that of the bag toy unit at swelling thereof, is ruptured at the swelling pressure of the bag toy unit, so that the bag toy unit flies out. At this time, if the accommodating bag unit is open on the moment, rupturing sound of the accommodating bag unit is accompanied with the opening, Further, in the case where opening time of the accommodating bag unit is late, the bag toy unit gradually appears so that unique movement is accompanied with the appearing of the bag toy unit.

As described above, the foaming agents of the foaming material, which have been reacted wiht each other within the bag toy unit, inflate the bag toy unit so that the latter tears the accommodating bag unit and flies out. Thus, by these processes, it is made possible to enjoy experience which is extremely rich in thrill, regardless of age and distinction of sex. Further, the bag toy unit swells to a predetermined configuration at a location on the outside of the accommodating bag unit. Accordingly, it is possible to enjoy the swelling bag toy unit per se as a mascot, an ornament or the like.

Preferably, the bag flying-out toy further includes an inner bag having accommodated therein the foaming material. The inner bag is so formed as to have its volume which is smaller than that of the bag toy unit. The inner bag is folded up together with the bag toy unit. The inner bag is ruptured within the bag toy unit immediately before reaction is completed due to gas generated by the foaming material.

With the above arrangement of the invention, a folded section of sections of the bag toy unit have a gap corresponding in thickness to the inner bag, so that the bag toy unit is prevented from becoming a sealed state at the folded section or sections. As a result, the gas filled into the bag toy unit from the inner bag passes through the gap at the folded section or sections of the bag toy unit, so that the gas is sent or fed to every nook and corner of the folded section or sections of the bag toy unit. When the inner bag is ruptured, the foaming agents of the foaming material within the inner bag have been reacted with each other sufficiently and begin to be already completed in reaction.

According to the above arrangement, it is possible to beforehand accommodate the foaming material having the plurality of foaming agents, in the inner bag. Thus, an accommodating operation of the foaming material into the bag toy unit is made easy, so that an attempt can be made to rationalization of manufacturing steps.

Moreover, by rupturing of bursting of the inner bag within the bag toy unit, the gas is fed into every nook and corner of the folded section or sections of the bag toy unit so that it is possible to inflate the folded bag toy unit normally or regularly. Specifically, since the inner bag is folded up, together with the bag toy unit, on the inside of the bag toy unit, the folded section or sections of the bag toy unit has the gap corresponding in thickness to the inner bag. Thus, the bag toy unit is prevented from becoming a sealed condition at the folded section or sections. As a result, the gas filled into the bag toy unit from the ruptured inner bag passes through the gap at the folded section or sections of the bag toy unit. Accordingly, it is ensured that the gas generated by the foaming material is fed into every nook and corner of the bag toy unit, without hindrance or disturbance of the folded section or sections. Thus, it can be dissolved that only a part or parts of the folded section or sections of the bag toy unit are ruptured. In this manner, it is ensured that the bag toy unit is inflated, and ruptures the accommodating bag unit so as to fly out therefrom.

Moreover, since, whrn the inner bag is ruptured, reaction of the foaming agents begins to be already completed, it can be prevented that the foaming material remains not reacted. As a result, there can always be obtained a predetermined amount of gas, and it is possible to sufficiently inflate the bag toy unit.

Preferably, the bag flying-out toy further includes a plurality of decorative small articles accommodated in the accommodating bag unit, in addition to the bag toy unit.

With the arrangement of the invention, when the bag toy unit flies out from the interior of the accommodating bag unit, the small accommodating articles simultaneously fly out in addition to the bag toy unit.

In the manner as described above, the decorative small articles fly out, together with the bag toy unit, from the interior of the accommodating bag unit. Accordingly, it is possible to use the bag flying-out toy as an ornamental scent bag or the like. thus, the bag flying-out toy becomes suitable for use in entertainment such as a party or the like. Further, the decorative small articles should not be limited to, for example, paper snowfall, but it is suitably select the decorative small article from a quiz game, a small piece having described thereon optional message, a small toy and so on. Thus, the bag flying-out toy becomes rich in wide use. Accordingly, it is made possible for the bag flying-out toy to do a play which is more rich in variation by the use of the decorative small articles, in addition to a play on the moment the bag toy flies out and a play of the flied-out bag toy as a mascot. Various plays extremely wide in scope or range are made possible, which are suitable for a difference in age, for distinction of sex and so on.

According to the invention, there is further provided a bag flying-out toy comprising:

a gas-tight bag toy unit;

a foaming material including a plurality of foaming agents which generate gas at mixing thereof, the foaming material being accommodated in the bag toy unit in a separated manner; and a substrate on which the bag toy unit before swelling rests; and a tearing cover for covering the bag toy unit on the substrate to fixedly mount the bag toy unit to the substrate, the tearing cover being torn off by a swelling pressure of the bag toy unit.

With the arrangement of the invention, the bag toy unit is fixedly mounted to the substrate, and is covered by the tearing cover. By the gas generated by the foaming material, the bag toy unit ruptures the tearing cover and flies out thereform.

Preferably, the bag flying-out toy further includes a protective element having its opening corressponding in configuration to the bag toy unit, the tearing cover having its upper surface onto which the protective element is mounted, and a swinging plate unit mounted on an upper surface of the protective element so as to cover the opening of the protective element.

With the above arrangement of the invention, the protective element and the swinging plate element cooperate with each other to protect the foaming material within the bag toy unit.

According to the above invention, the bag toy unit before swelling is protected by the substrate, the tearing cover, the protective element and the swinging plate element. Thus, it can be ensured that the bag toy unit is accommodated and transported without inadvertent reaction of the foaming material. Further, since it is possible to accommodate the bag toy unit in a compact manner, the configuration of the bag flying-out toy can be formed into a card-like configuration. Thus, the bag flying-out toy is convenient also for mailing and so on.

As described above, according to the invention, there are provided the following various functional advantages which are practically effective:

(1) By the manner of movement and flying-out of the bag toy unit, it is possible to enjoy experience which is extremely rich in thrill, ragardless of age and distinction of sex.

(2) Handling of the bag flying-out toy is easy so that it can be ensured to inflate the bag toy unit even if anyone handles the bag flying-out toy.

(3) Even after the bag toy unit has flown out, extremely unique play is made possible.

(4) Accommodating operation of the foaming agent unit is made easy, so that an attempt can be made to rationalization of manufacturing steps of the bag flying-out toy.

(5) At accommodation and transportation, it is possible to prevent the foaming agents of the foaming material, which are accommodated in the bag toy unit in a separated manner, from being inadvertently reacted with each other.

DESCRIPTION OF THE EMBODIMENTS

Figure 1:
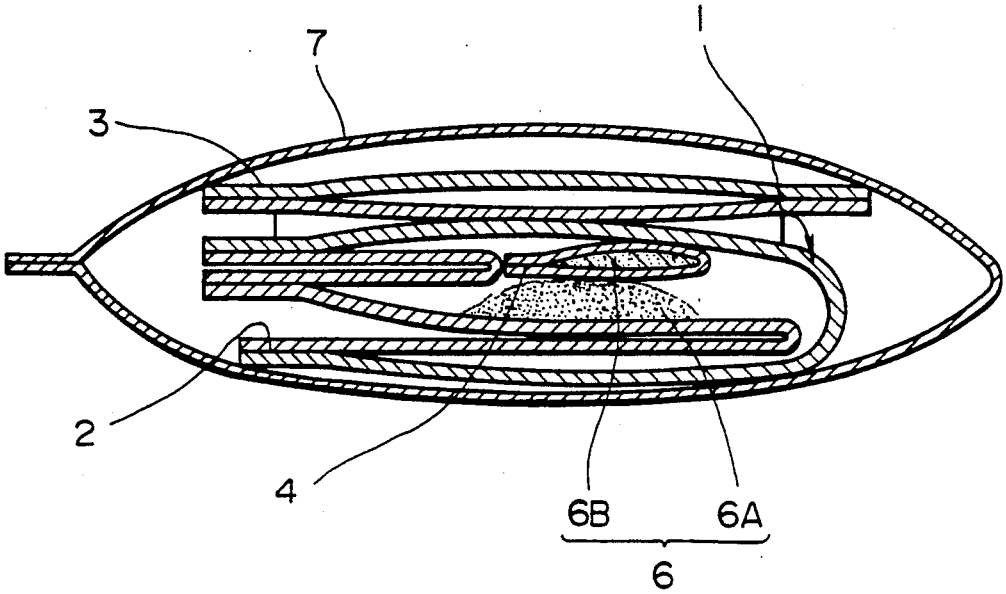
FIg. 1 is a cross-sectional view of a bag flying-out toy according to an embodiment of the invention.
Figure 2:
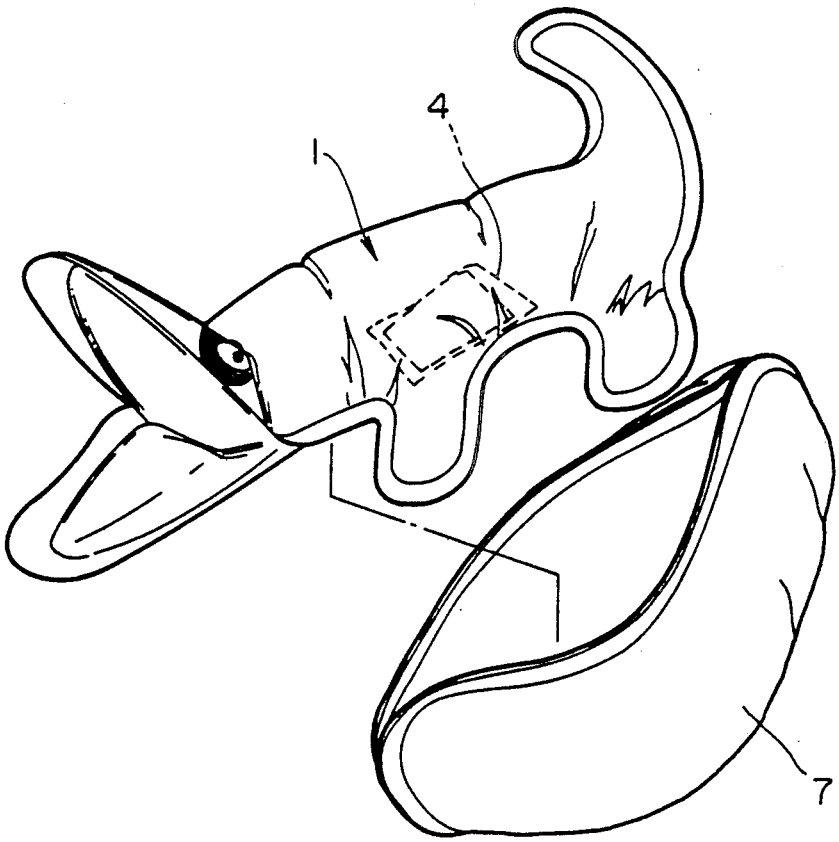
FIG. 2 is a perspective view showing a state in which a bag toy unit illustrated in FIG. 1 is inflated to a predetermined configuration.

Referring to FIGS. 1 and 2, there is shown a bag flying-out toy according to an embodiment of the invention. The bag flying-out toy comprises a bag toy unit 1 in which a gas-tightly sealed bag is formed into a predetermined comfiguration. The bag toy unit 1 is inflated by pressure of gas obtained by a foaming material 6. The bag toy unit 1 plans to use a film material 3 such as a simple-substance polyethylene film or a composite film material in which a nylon film or the like is stuck onto or superimposed upon the polyethylene film. PArticularly, when the composite film material is used, the can be obtained such a functional advantage that it is possible to relatively lengthen the holding time of the gas as compared with the simple-substance polyethylene film. The film material 3 includes a plurality of cut sheets which are bonded to each other by adhesives 2.

The foaming material 6 is used in which a main agent 6A and a secondary agent 6B are chemically reacted with each other to generate gas. As shown in FIG. 1, the secondary agent 6B is accommodated in a sealed bag 4, which is easy to be opened, so that the main agent 6A and the secondary agent 6B are separated from each other. At this time, sodium hydrogencarbonate is used as the main agent 6A of the foaming material 6, and citric acid or the like is used as the secondary agent 6B. By doing so, the foaming material 6 has no harm to man and beast and, further, since the gas generated is carbon dioxide, there is provided a swelling action which is extremely safe. Moreover, with reference to the kind or type of the foaming material 6, it is possible to suitably select the conventional known materials, in addition to that mentioned above.

In the foaming material 6 according to the embodiment, the aqueous-soluble secondary agent 6B is put into the planar sealed bag 4 in which a peripheral edge of a folded sheet material is heat-sealed, and the powder main agent 6A is arranged on the outside of the sealed bag 4. Both side surfaces of the sealed bag 4 is forcibly pressed by finger, whereby the heat-sealed section is open. By doing so, when the sealed bag 4 bursts so that the secondary agent 6B leaks out, the secondary agent 6B is mixed with the main agent 6A.

The bag toy unit 1 is accommodated in an accommodating bag 7. As will be understood from FIG. 2, the accommodating bag 7 has its volume at inflation thereof, which is smaller than the volume of the bag toy unit 1 at inflation thereof. Thus, the accommodating bag 7 is so formed as to be easily ruptured by the swelling pressure of the bag toy unit 1. The accommodating bag 7 in the illustrated embodiment is formed into an oval configuration by a polyethylene resinous materinal or the like. The bag toy unit 1 formed into a configuration such as an animal or the like is accommodated in the accommodating bag 7. Further, it is not required that the accommodating bag 7 has gas-tightness such as the bag toy unit 1. For instance, it is possible to form the accommodating bag 7 by the use of a paper material such that the accommodating bag 7 is easily ruptured. By doing so, there can be obtained such a functional advantage that large busting or breaking sound occurs when the accommodating abg 7 made of paper is ruptured.

Figure 3:
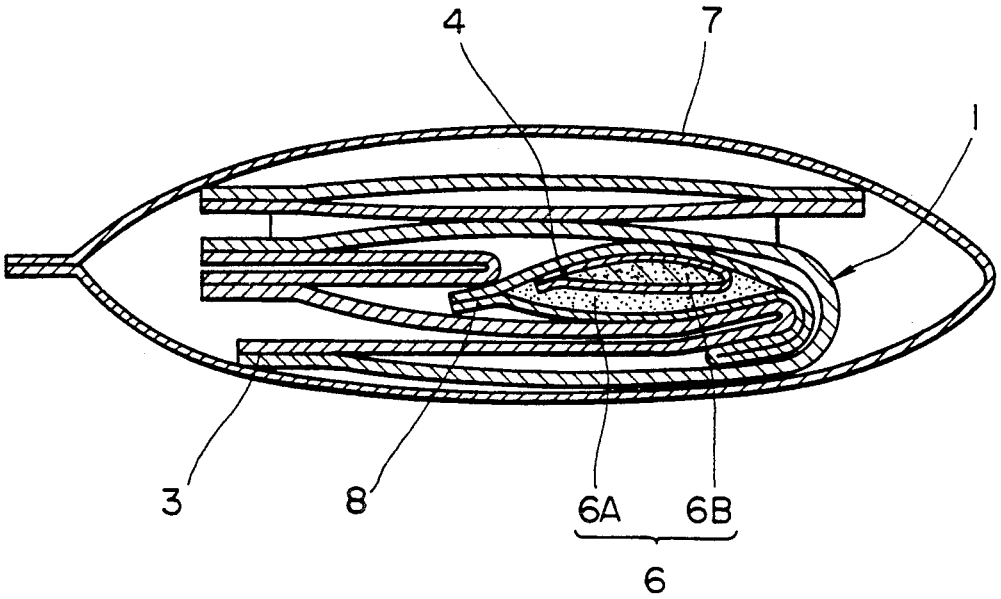
FIg. 3 is a cross-sectional view of a bag flying-out toy according to another embodiment of the invention.

Referring next to FIG. 3, there is shown a bag flying-out toy according to another embodiment of the invention. In FIG. 3, components and parts like or similar to those illustrated in FIGS. 1 and 2 are designated by the same reference numerals, and the description of the like or similar components and parts will be simplified for avoiding duplication.

FIg. 3 shows a stat in which the foaming material composed of the main agent 6A and the secondary agent 6B is accommodated in an inner bag 8. That is, the inner bag 8 is accommodated in the bag toy unit 1, and is so formed as to be smaller in volume than the bag toy unit 1. At accommodation, the inner bag 8 is folded up together with the bag toy unit 1. The inner bag 8 is so formed as to be ruptured within the bag toy unit 1 immediately before reaction is completed due to the gas generated by the foaming material 6. By doing so, the gas generated by the foaming material 6 inflates the inner bag 8 before inflating the bag toy unit 1, to rupture the inner bag 8. If so, the gas due to the foaming material 6 is fed into every nook and corner of the folded bag toy unit 1 by the force having ruptured the inner bag 8, so that the gas is spread over the entire bag toy unit 1. As a result, the gas generated due to the foaming material 6 is prevented from being one-sided or prejudiced to parts of the folded bag toy unit 1, so that the bag toy unit 1 is prevented from being ruptured by the gas partially concentrated.

Moreover, when the inner bag 8 is ruptured, bursting or rupturing sound occurs. Accordingly, it is also possible to further add thrilling taste.

Figure 4:
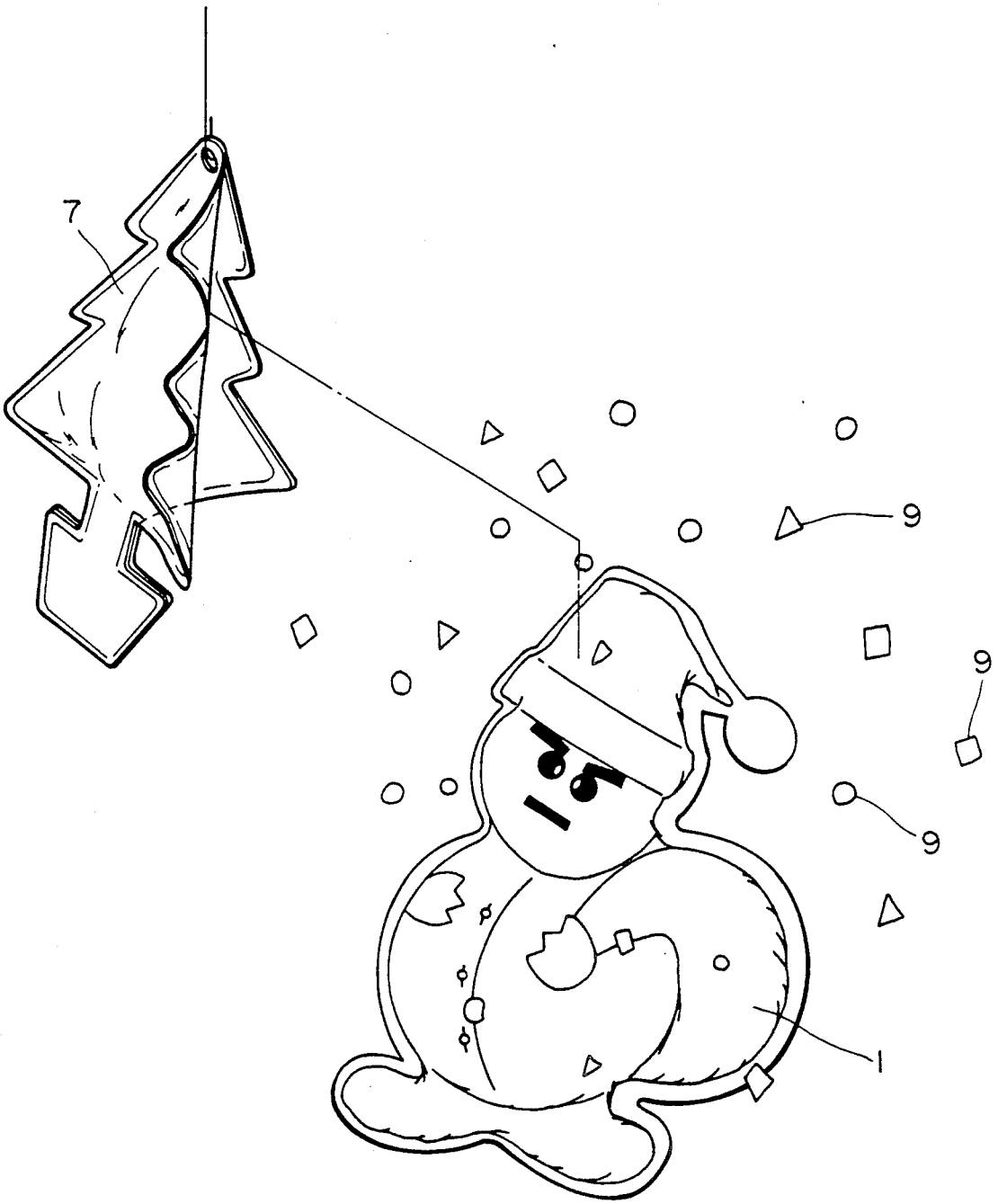
FIG. 4 is a cross-sectional view of a bag flying-out toy according to still another embodiment of the invention.

Referring next to FIG. 4, there is shown a bag flying-out toy according to still another embodiment of the invention. In FIG. 4, components and parts like or similiar to those illustrated in FIGS. 1 and 2 are designated by the same reference numerals, and the description of the like or similar components and parts will be simplified.

FIg. 4 shows a state in which a plurality of decorative small articles 9 are accommodated, together with the bag toy unit 1, in the accommodating bag 7. At this time, for example, paper snowfall or the like is palnted as the decorative small articles 9. By doing so, when the accommodating bag 7 is broken or bursts, the paper snowfall is scattered through the tear of the accommodating bag 7. Thus, by suspending the bag flying-out toy according to the embodiment at a high location, the bag flying-out toy can also be used as an ornamental scent bag, so that the bag flying-out toy becomes suitable as that used in an entertainment such as a party or the like, Moreover, the decorative small articles 9 should not be limited to the paper snowfall. A quiz game, a small piece having described thereon optional message, a small toy or the like can suitably be selected as the decorative small articles 9.

Figure 5:
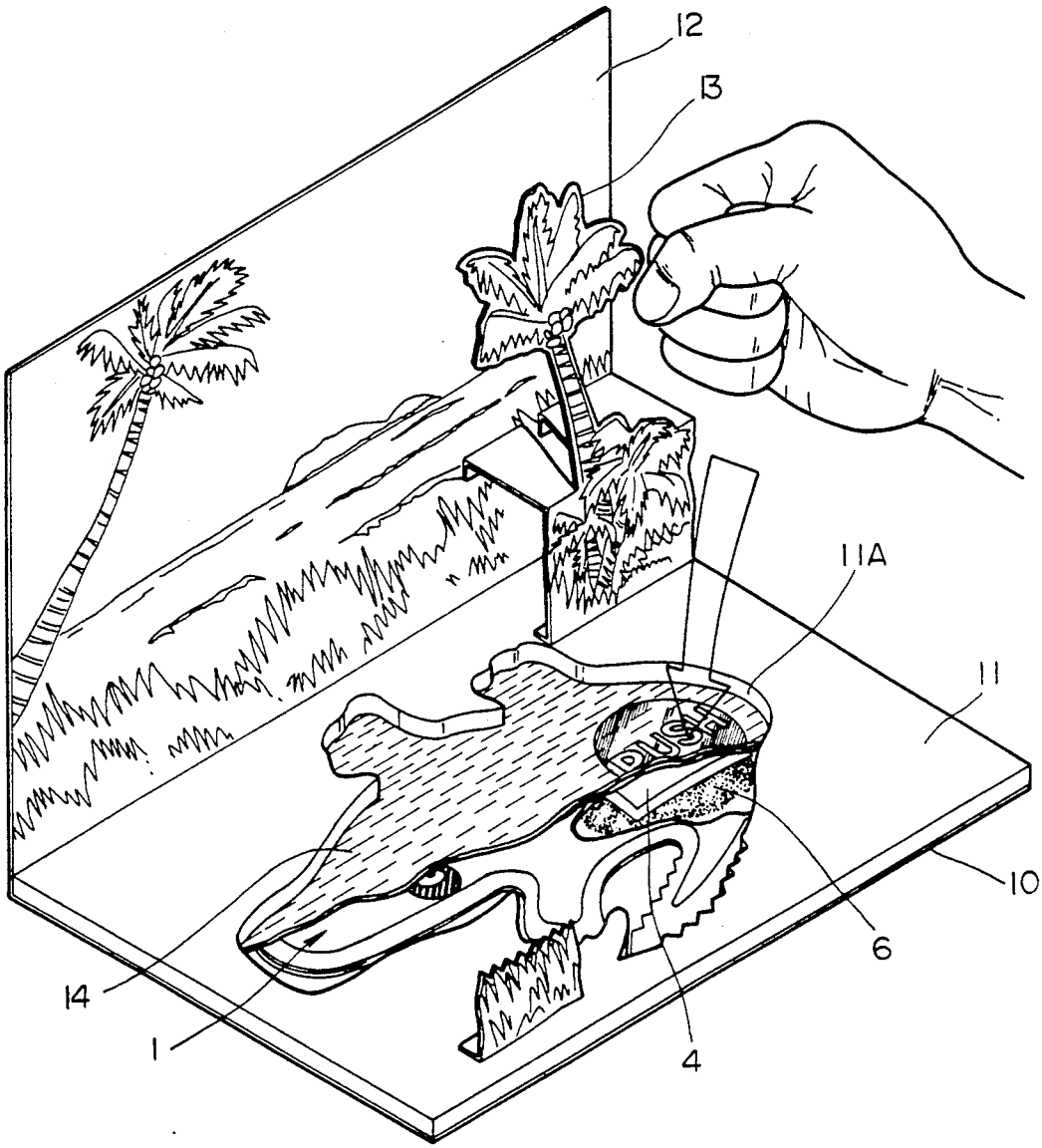
FIg. 5 is a cross-sectional view of a bag flying-out toy according to another embodiment of the invention.
Figure 6:
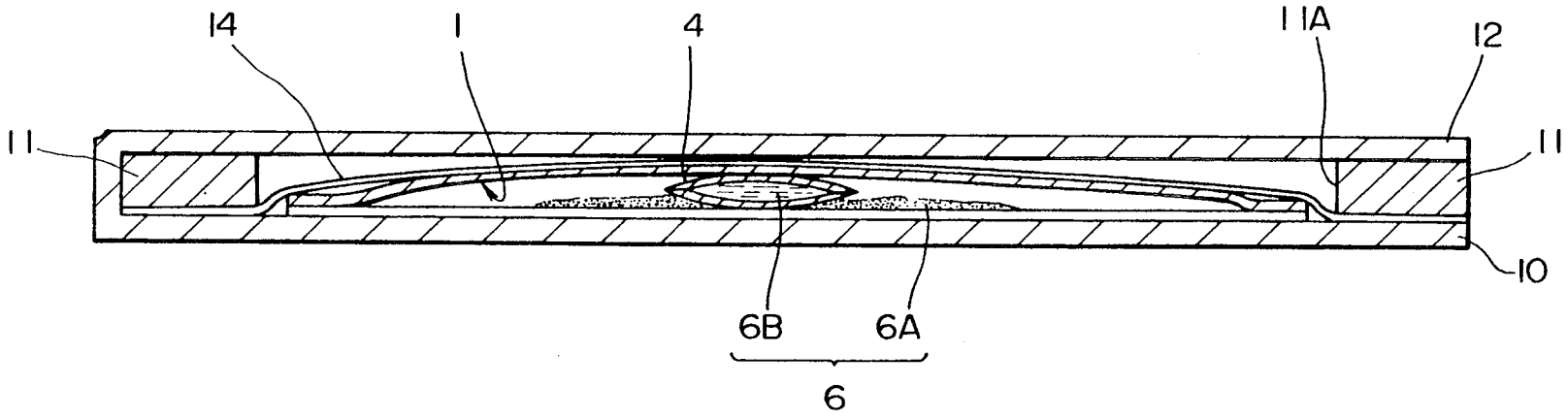
FIG. 6 is a cross-sectional view of the bag flying-out toy illustrated in FIG. 5.

Referring next to FIGS. 85 and 6, there is shown a bag flying-out toy according to another embodiment of the invention. In FIGS. 5 and 6, components and parts like or similar to those illustrated in FIGS. 1 and 2 are designated by the same reference numerals, and the description of the like or similar components and parts will be simplified.

The bag toy unit 1 shown in FIGS. 5 and 6 is accommadated in a tearing cover 14. The bag toy unit 1 before swelling rests on a substrate 10. The tearing cover 14 covers the bag toy unit 1 on the substrate 10 to fixedly mount the bag toy unit 1 to the substrate 10. The tearing cover 14 is torn off at the swelling pressure of the bag toy unit 1. The bag toy unit 1 is protected by a protective element 11 having an opening 11A corresponding in configuration to the bag toy unit 1, and a swinging plate element 12 for covering the opening 11A of the protective element 11. When the bag toy unit 1 is to be inflated, the swinging plate element 12 is moved angularly and is open, so that the main and secondary agents 6A and 6B of the foaming material 6 within the bag toy unit 1 are reacted with each other. If so, the bag unit 1 protrudes onto the upper surface of the protective element 11 from the opening 11A therein. By doing so, since the bag toy unit 1 before swelling is protected by the substrate 10, the protective element 11 and the swinging plate element 12, it is possible to secure that the bag flying-out toy is accommodated and transported without inadvertent reaction between the main and secondary agents 6A and 6B of the foaming material 6. Further, sinse the swinging plate element 12 is formed, for angular movement, along the side edges of the respective substrate 10 and protective element 11, when the swinging plate element 12 is open, it is possible to raise decorative effects of the bag toy unit 1 at swelling, by a decorative article 13 which is provided on the inward side of the swinging plate element 12, on the upper surface of the protective element 11, or between the swinging plate element 12 and the protective element 11. Further, since the bag flying-out toy according to the illustrated embodiment can be accommodated in a compact manner in construction, it is also possible to form the configuration of the toy into a card-like configuration. Thus, the bag flying-out toy is convenient in mailing and so on.

What is claimed is:

1. An inflatable toy unit comprising:

a gas-tight inflatable toy body;

a foaming material including a plurality of foaming agents which generate gas upon mixing thereof, said foaming agents being disposed in said toy body separate from one another so as to be mixable by manual operation;

a substrate for storing said toy body in an uninflated condition;

a covering plate for covering said toy body when stored in said uninflated condition on said substrate and holding said toy body against said substrate, said cover being secured to said substrate for movement between a position covering said toy body when stored in said uninflated condition on said substrate and a position uncovering said toy body so that said toy body is capable of inflating upon generation of the gas; and a protective means arranged between said substrate and said covering plate for maintaining said substrate and said covering plate spaced one from the other and defining a space for said toy body therebetween when said covering platge covers said toy body in said uninflated condition.

2. An inflatable toy unit according to claim 1, wherein said protective means comprises a protective element having said walls defining an opening for receiving said toy body.

3. An inflatable toy unit according to claim 2, wherein said protective element is formed in a plate shape having an aperture defining said side walls.

4. An inflatable toy unit according to claim 1, wherein said covering plate is secured to said substrate at their edge portions.

5. An inflatable toy unit according to claim 4, wherein said covering plate and said substrate are integrally formed and substantially rigid.

6. An inflatable toy unit according to claim 1 wherein said inflatable toy body is made of double layer film comprising a polyethylene layer and a nylon layer.

7. An inflatable toy unit comprising:

a gas-tight inflatable toy body;

a foaming material including a plurality of foaming agents which generate gas upon mixing thereof, said foaming agents being disposed in said toy body separate from one another;

a substrate for storing said toy in an uninflated condition;

a cover for covering said toy body when stored in said uninflated condition on said substrate and holding said toy body against said substrate, said cover being secured to said substrate for movement between a position covering said toy body when stored in said uninflated condition on said substrate and a ruptured position uncovering said toy in response to inflation thereof upon generation of the gas; and including a protective element on said substrate and having side walls defining an opening for receiving said toy body, said cover overlying side toy body in said opeing, and a plate element overlying said cover and mounted for movement between a position overlying said cover and a position permitting the cover to rupture and said toy body to inflate.

8. The inflatable toy unit according to claim 7 wherein said foaming material includes a main agent and a secondary agent which are chemically reacted with each other to generate the gas.

9. The inflatable toy unit according to claim 8 wherein said secondary agent is aqueous soluble, said toy body including a sealed bag formed of sheet material and into which said aqueous-soluble secondary agent is located, said sheet material being formed such that peripheral edges thereof are heat-sealed to form the sealed bag, said main agent being powder and disposed outside of said sealed bag.

10. The inflatable toy unit according to claim 7 wherein said substrate, said toy body and said cover have length, width and depth dimensions to form a card-like toy suitable for

* * * * *